US008419229B2

(12) United States Patent
Dong

(10) Patent No.: US 8,419,229 B2
(45) Date of Patent: Apr. 16, 2013

(54) ELECTRONIC DEVICE AND LIGHTING UNIT THEREOF

(75) Inventor: Chao-Sheng Dong, Taipei County (TW)

(73) Assignee: Everlight Electronics Co., Ltd., Taipei (TW)

( * ) Notice: Subject to any disclaimer, the term of this patent is extended or adjusted under 35 U.S.C. 154(b) by 313 days.

(21) Appl. No.: 13/017,523

(22) Filed: Jan. 31, 2011

(65) Prior Publication Data

US 2011/0194289 A1 Aug. 11, 2011

(30) Foreign Application Priority Data

Feb. 9, 2010 (TW) ..... 99103899 A

(51) Int. Cl.
*F21V 7/10* (2006.01)
*F21V 7/00* (2006.01)
*F21V 3/00* (2006.01)

(52) U.S. Cl.
USPC ..... 362/311.02; 362/296.01; 362/296.1; 362/327; 362/311.12; 362/311.1

(58) Field of Classification Search ..... 362/311.02, 362/296.01, 296.1, 327, 311.12, 311.1
See application file for complete search history.

(56) References Cited

U.S. PATENT DOCUMENTS 4,714,983 A 12/1987 Lang
6,547,423 B2 * 4/2003 Marshall et al. ..... 362/333
6,582,103 B1 6/2003 Popovich et al.
2004/0201987 A1 10/2004 Omata
2005/0286252 A1 12/2005 Hanano
2006/0091784 A1 * 5/2006 Conner et al. ..... 313/498
2006/0120085 A1 6/2006 Hsieh et al.
2007/0012940 A1 1/2007 Suh et al.
2007/0145397 A1 * 6/2007 DenBaars et al. ..... 257/98
2009/0268469 A1 10/2009 Huang et al.

FOREIGN PATENT DOCUMENTS

CN 201037888 Y 3/2008
TW 562954 11/2003
TW M351317 2/2009
TW 200925514 6/2009

* cited by examiner

*Primary Examiner* — Stephen F Husar
*Assistant Examiner* — James Cranson, Jr.
(74) *Attorney, Agent, or Firm* — Muncy, Geissler, Olds & Lowe, PLLC

(57) ABSTRACT

A lighting unit is provided. The lighting unit includes a light source and an optical element. The light source provides a major light beam and a minor light beam. The optical element includes a first light entering surface, a second light entering surface, a light distributing surface, a light emitting surface and a normal line, wherein the normal line is perpendicular to the light emitting surface, and the second light entering surface is a scattering surface, and the major light beam enters the optical element through the first light entering surface, and is emitted from the light emitting surface, and the minor light beam enters the optical element through the second light entering surface, is reflected by the light distributing surface, and is emitted from the light emitting surface.

20 Claims, 4 Drawing Sheets

ELECTRONIC DEVICE AND LIGHTING UNIT THEREOF

CROSS REFERENCE TO RELATED APPLICATIONS

This application claims priority of Taiwan Patent Application No. 099103899, filed on Feb. 9, 2010, the entirety of which is incorporated by reference herein.

BACKGROUND OF THE INVENTION

1. Field of the Invention

The present invention relates to a lighting unit, and in particular relates to a lighting unit which can prevent yellow halos.

2. Description of the Related Art

White light emitting diodes generally have yellow halo problem caused by non-uniformed phosphor powder spread. The yellow halo problem is enhanced when the white emitting diodes are applied with spotlight optical elements. Conventionally, to prevent yellow halo, a nebulized area is formed on a light emitting surface of the spotlight optical element. However, the nebulized area increases light emitting angle (at least 5°), which hinders small light emitting angle requirements. Also, light maxing effect of the nebulized area is insufficient, which decreases reduction of the yellow halo.

SUMMARY OF THE INVENTION

A detailed description is given in the following embodiments with reference to the accompanying drawings.

A lighting unit is provided. The lighting unit includes a light source and an optical element. The light source provides a major light beam and a minor light beam. The optical element includes a first light entering surface, a second light entering surface, a light distributing surface, a light emitting surface and a normal line, wherein the normal line is perpendicular to the light emitting surface, and the second light entering surface is a scattering surface, and the major light beam enters the optical element through the first light entering surface, and is emitted from the light emitting surface, and the minor light beam enters the optical element through the second light entering surface, is reflected by the light distributing surface, and is emitted from the light emitting surface.

In the embodiments of the invention, the minor light beam is scattered by the second light entering surface (nebulized surface). Therefore, there is sufficient space and margin to modify the direction of the minor light beam before the minor light beam reaches the light emitting surface. The direction of the minor light beam is modified via the design of the shape of the light distributing surface. The embodiment of the invention sufficiently mixes the major light beam and the minor light beam, so that the yellow halo problem is prevented, and light emitting angle is decreased.

In a modified embodiment, a light source with a high-intensity major light beam is applied to control the light emitting angle. In this embodiment, the light emitting angle (from the light emitting surface) of the minor light beam can be between 30° and 60° to maximize the output of the major light beam and the minor light beam, and to remove yellow halos.

In one embodiments of the invention, an electronic device comprising an imaging unit and a lighting unit is provided. The lighting unit provides an initial light beam to the imaging unit. The lighting unit comprises a light source and an optical element. The light source provides a major light beam and a minor light beam. The optical element comprises a first light entering surface, a second light entering surface, a light distributing surface, a light emitting surface and a normal line. The normal line is perpendicular to the light emitting surface, and the second light entering surface is a scattering surface. The major light beam enters the optical element through the first light entering surface, and is emitted from the light emitting surface. The minor light beam enters the optical element through the second light entering surface. The minor light beam scattered by the second light entering surface is reflected by the light distributing surface, and the minor light beam reflected by the light distributing surface is emitted from the light emitting surface. The initial light beam is formed by the major light beam and the minor light beam.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

It has been observed, that in a white light emitting diode, a yellow light is produced from a minor light beam emitted from a lateral side of the light emitting diode. Therefore, the embodiment of the invention controls the direction of the minor light beam to prevent yellow halos.

Figure 1:
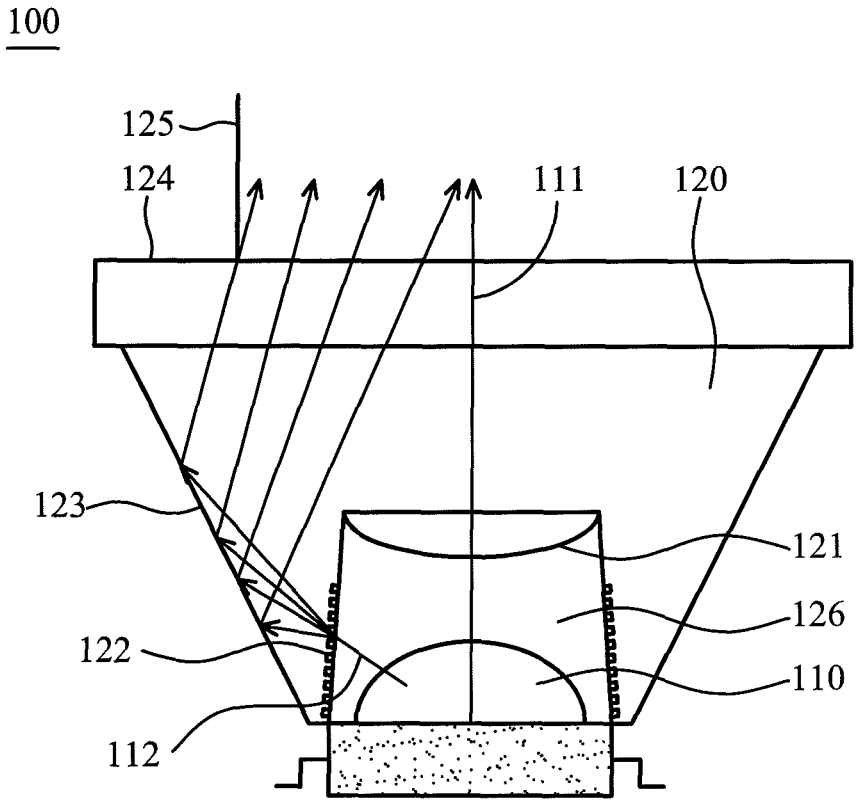
FIG. 1 shows a lighting unit of a first embodiment of the invention.

Referring to FIG. 1, a lighting unit 100 of a first embodiment of the invention is shown. The lighting unit 100 comprises a light source 110 and an optical element 120. The light source 110 provides a major light beam 111 and a minor light beam (lateral light beam, yellow light beam) 112. The optical element 120 comprises a first light entering surface 121, a second light entering surface 122, a light distributing surface 123, a light emitting surface 124 and a normal line 125. The normal line 125 is perpendicular to the light emitting surface 124. The second light entering surface 122 is a scattering surface. The major light beam 111 enters the optical element 120 through the first light entering surface 121, and is emitted from the light emitting surface 124. The minor light beam 112 enters the optical element 120 through the second light entering surface 122. The light beam scattered by the second light entering surface 122 is reflected by the light distributing surface 123. The light beam reflected by the light distributing surface 123 is emitted from the light emitting surface 124.

In one embodiment, the light source 110 is a light emitting diode.

The optical element 120 is a collimator. The first light entering surface 121 is a convex downward surface facing the light source 110. The optical element 120 further has a groove 126. The groove 126 has a top portion and a lateral portion.

The lateral portion of the groove 126 is a continuous wall. The first light entering surface 121 is formed on the top portion of the groove 126, and the second light entering surface 122 is formed on the lateral portion of the groove 126. In one embodiment, the first light entering surface 121 is a proximal surface adjacent to the light source 110 and the light emitting surface 124 is a distal surface that is remote from the light source 110. The second light entering surface extends from the first light entering surface 121 to the bottom portion of the light distributing surface 123. The light emitting surface 124 is connected to the top portion of the light distributing surface 123.

In the first embodiment, the light distributing surface 123 has an identical slope which is relative to the light emitting surface 124.

Figure 2:
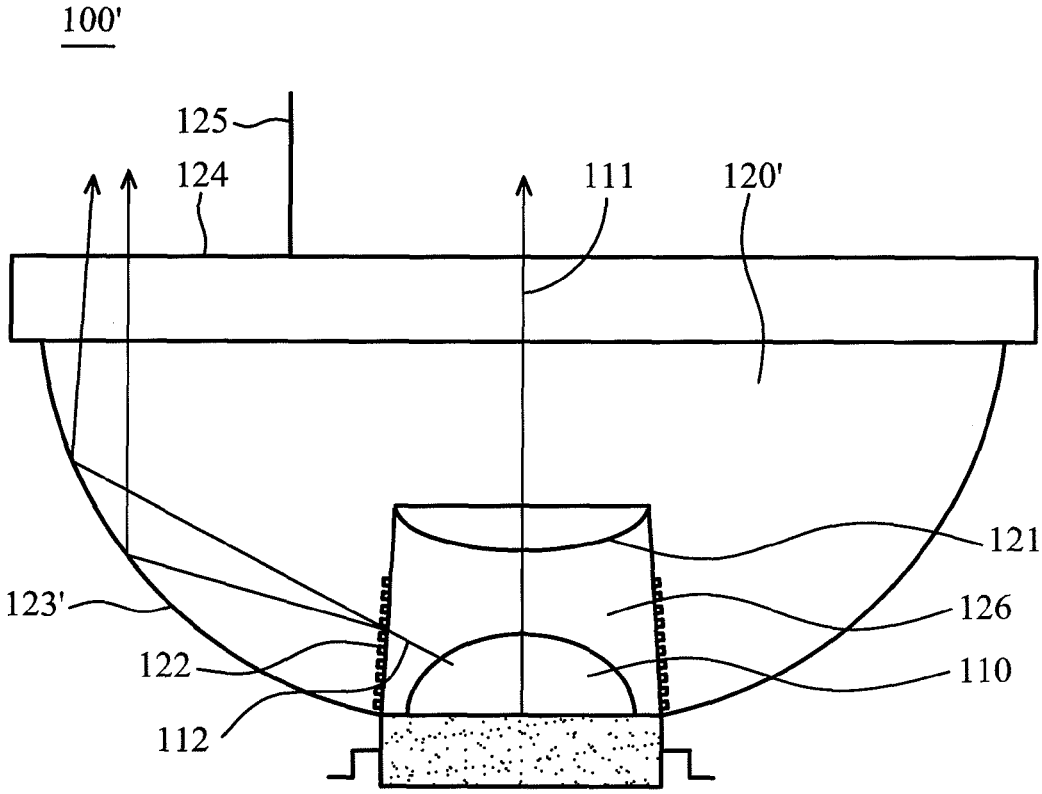
FIG. 2 shows a lighting unit of a second embodiment of the invention.

Referring to FIG. 2, a lighting unit 100' of a second embodiment of the invention is shown. The light unit 100' differs with the light unit 100 in that an optical element 120'. The optical element 120' differs with the optical element 120 in that a second light entering surface 123'. Similar to the first embodiment, the lighting unit 100' comprises a light source 110 and an optical element 120'. The light source 110 provides a major light beam 111 and a minor light beam 112. The optical element 120' comprises a first light entering surface 121, a second light entering surface 122, a light distributing surface 123', a light emitting surface 124 and a normal line 125. The normal line 125 is perpendicular to the light emitting surface 124. The second light entering surface 122 is a scattering surface. The major light beam 111 enters the optical element 120 through the first light entering surface 121, and is emitted from the light emitting surface 124. The minor light beam 112 enters the optical element 120 through the second light entering surface 122. The light beam scattered by the second light entering surface 122 is reflected by the light distributing surface 123'. The light beam reflected by the light distributing surface 123' is emitted from the light emitting surface 124. In the second embodiment, the light distributing surface 123' is a curved surface or a concave upward surface, which changes relative to the light emitting surface 124.

In the embodiments above, a light emitting direction of the minor light beam 122 from the light emitting surface 124 can be controlled by the shape of the light distributing surface. In one embodiment, the light distributing surface reflects the light beam scatted by the second light entering surface in the way of total reflection. In other embodiment, the light distributing surface may be formed of and/or coated with a reflective material such as aluminum and/or silver. For example, in the first embodiment, an included angle is formed between the minor light beam 112 and the normal line 125, and the included angle is between 30° and 60°. In the second embodiment, the included angle formed between the minor light beam 112 and the normal line 125 can be smaller than 30°. In the embodiments of the invention, the minor light beam 112 is scattered by the second light entering surface 122 (nebulized surface). Therefore, there is sufficient space and margin to modify the direction of the minor light beam 122 before the minor light beam 122 reaches the light emitting surface 124. The direction of the minor light beam 122 is modified via the design of the shape of the light distributing surface. The embodiment of the invention sufficiently mixes the major light beam and the minor light beam, so that the yellow halo problem is prevented, and light emitting angle is decreased.

In a modified embodiment, a light source with a high-intensity major light beam is applied to control the light emitting angle. In this embodiment, the light emitting angle (from the light emitting surface) of the minor light beam can be between 30° and 60° to maximize the output of the major light beam and the minor light beam, and to remove yellow halos.

Figure 3:
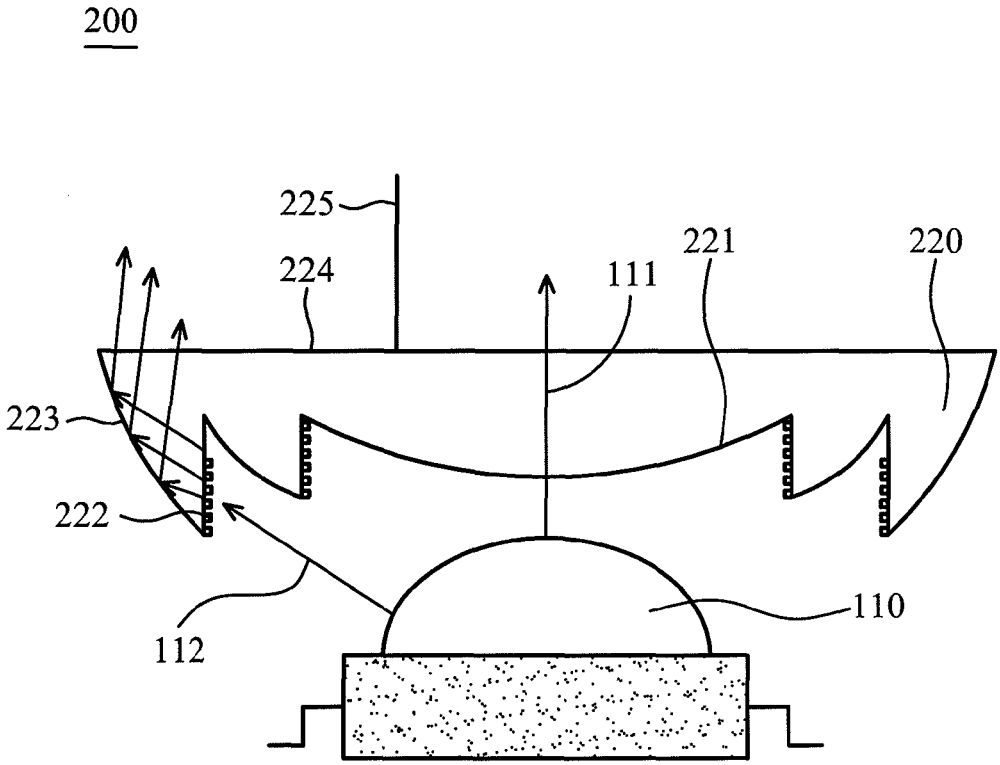
FIG. 3 shows a lighting unit of a third embodiment of the invention.

Referring to FIG. 3, a lighting unit of a third embodiment of the invention is shown. The lighting unit 200 comprises a light source 110 and an optical element 220. The light source 110 provides a major light beam 111 and a minor light beam 112. The optical element 220 comprises a first light entering surface 221, second light entering surfaces 222, light distributing surfaces 223, a light emitting surface 224 and a normal line 225. The normal line 225 is perpendicular to the light emitting surface 224. The second light entering surfaces 222 are scattering surfaces. The major light beam 111 enters the optical element 220 through the first light entering surface 221, and is emitted from the light emitting surface 224. The minor light beam 112 enters the optical element 220 through the second light entering surfaces 222. The light beam scattered by the second light entering surfaces 222 is reflected by the light distributing surfaces 223. The light beam reflected by the light distributing surfaces 223 is emitted from the light emitting surface 224. In the third embodiment, the optical element 220 is a Fresnel lens. The normal line 225 is parallel to the second light entering surfaces 222. The light distributing surface 223 can be designed to control a light emitting angle and to remove yellow halos.

In the embodiments of the invention, the second light entering surfaces are nebulized surfaces to provide a scattering function. However, the invention is not limited thereto, and other scattering structures can also be formed on the second light entering surfaces to provide a scattering function.

Figure 4:
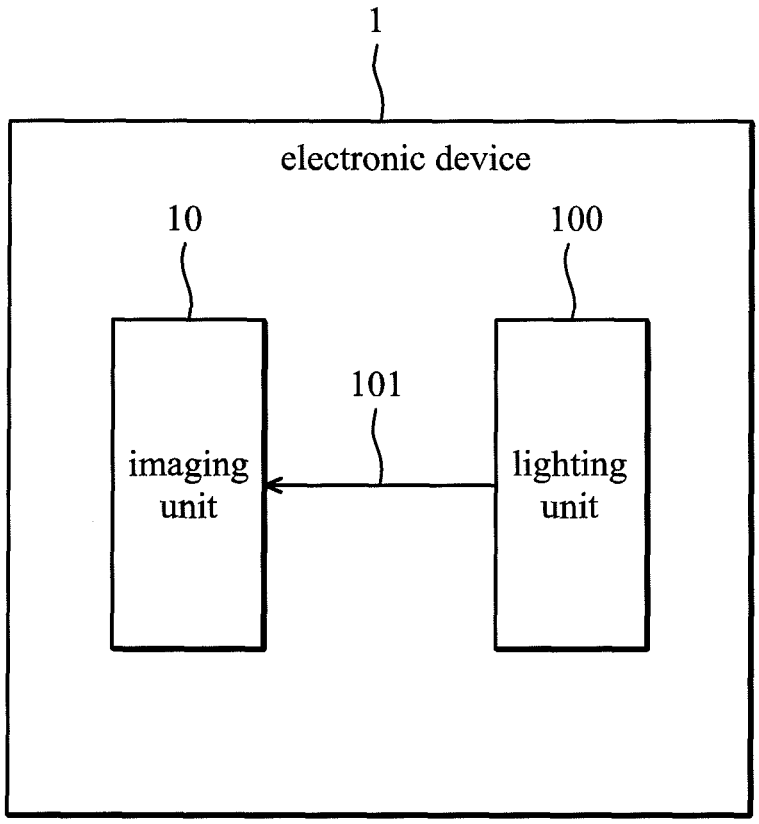
FIG. 4 shows an electronic device utilizing the lighting unit of the embodiments of the invention.

Referring to FIG. 4, the lighting unit 100 of the embodiments of the invention utilized in an electronic device 1 is shown. The electronic device 1 includes a light unit 100 and an image unit 10. The lighting unit 100 provides an initial light beam 101 to the imaging unit 10. The initial light beam 101 is formed by the major light beam 111 and the minor light beam 112. In one embodiment, the light unit 100 may be replaced by the light unit 100' or 200. In other embodiment, the electronic device 1 includes cellular phone, personal digital assistant (PDA), notebook computer, flat computer, computer monitor, flat display and television.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lighting unit, comprising:

a light source providing a major light beam and a minor light beam; and an optical element comprising a first light entering surface, a second light entering surface, a light distributing surface, a light emitting surface and a normal line, wherein the normal line is perpendicular to the light emitting surface, and the second light entering surface is a scattering surface, and the major light beam enters the optical element through the first light entering surface, and is emitted from the light emitting surface, and the minor light beam enters the optical element through the second light entering surface, the minor light beam scattered by the second light entering surface is reflected by the light distributing surface, and the minor light beam reflected by the light distributing surface is emitted from the light emitting surface.

2. The lighting unit of claim 1, wherein the light source includes a light emitting diode.

3. The lighting unit of claim 1, wherein the first light entering surface includes a convex surface.

4. The lighting unit of claim 3, wherein the optical element includes a collimator.

5. The lighting unit of claim 4, wherein a groove is formed on the optical element, the groove includes a top portion and a lateral portion, the first light entering surface is formed on the top portion, and the second light entering surface is formed on the lateral portion.

6. The lighting unit of claim 3, wherein the optical element includes a Fresnel lens.

7. The lighting unit of claim 6, wherein the normal line is parallel to the second light entering surface.

8. The lighting unit of claim 1, wherein after the minor light beam is emitted from the light emitting surface, an included angle is formed between the minor light beam and the normal line, and the included angle is smaller than 30°.

9. The lighting unit of claim 1, wherein after the minor light beam is emitted from the light emitting surface, an included angle is formed between the minor light beam and the normal line, and the included angle is between 30° and 60°.

10. The lighting unit of claim 1, wherein the second light entering surface includes a nebulized surface.

11. An electronic device, comprising:

an imaging unit; and a lighting unit providing an initial light beam to the imaging unit, wherein the lighting unit comprises:

a light source providing a major light beam and a minor light beam; and an optical element comprising a first light entering surface, a second light entering surface, a light distributing surface, a light emitting surface and a normal line, wherein the normal line is perpendicular to the light emitting surface, and the second light entering surface is a scattering surface, and the major light beam enters the optical element through the first light entering surface, and is emitted from the light emitting surface, and the minor light beam enters the optical element through the second light entering surface, the minor light beam scattered by the second light entering surface is reflected by the light distributing surface, and the minor light beam reflected by the light distributing surface is emitted from the light emitting surface, wherein the initial light beam is formed by the major light beam and the minor light beam.

12. The electronic device of claim 11, wherein the light source includes a light emitting diode.

13. The electronic device of claim 11, wherein the first light entering surface includes a convex surface.

14. The electronic device of claim 13, wherein the optical element includes a collimator.

15. The electronic device of claim 14, wherein a groove is formed on the optical element, the groove includes a top portion and a lateral portion, the first light entering surface is formed on the top portion, and the second light entering surface is formed on the lateral portion.

16. The electronic device of claim 13, wherein the optical element includes a Fresnel lens.

17. The electronic device of claim 16, wherein the normal line is parallel to the second light entering surface.

18. The electronic device of claim 11, wherein after the minor light beam is emitted from the light emitting surface, an included angle is formed between the minor light beam and the normal line, and the included angle is smaller than 30°.

19. The electronic device of claim 11, wherein after the minor light beam is emitted from the light emitting surface, an included angle is formed between the minor light beam and the normal line, and the included angle is between 30° and 60°.

20. The electronic device of claim 11, wherein the second light entering surface includes a nebulized surface.

* * * * *